US005297943A

United States Patent [19]

Martin

[11] Patent Number: 5,297,943

[45] Date of Patent: Mar. 29, 1994

[54] ELECTRICAL SUBMERSIBLE PUMP DISCHARGE HEAD

[75] Inventor: Fred S. Martin, Claremore, Okla.

[73] Assignee: Baker Hughes Incorporated, Houston, Tex.

[21] Appl. No.: 37,762

[22] Filed: Mar. 26, 1993

[51] Int. Cl.[5] ..... F04B 17/00

[52] U.S. Cl. ..... 317/422; 174/65 R; 166/66.4

[58] Field of Search ..... 417/422, 423.3; 174/87, 174/65 R, 14 R, 70 R, 70 S; 166/65.1, 65.4; 310/87

[56] References Cited

U.S. PATENT DOCUMENTS

| | | | |
|---|---|---|---|
| 2,233,890 | 3/1941 | Hoover | 417/422 |
| 2,236,887 | 4/1941 | Arutunoff | 417/414 |
| 2,283,117 | 8/1942 | Arutunoff | 417/422 |
| 2,670,686 | 3/1954 | Bergh | 417/422 |
| 2,722,892 | 11/1955 | French | 417/422 |
| 3,170,520 | 2/1965 | Arutunoff | 166/65.1 |
| 3,411,454 | 11/1968 | Arutunoff | 417/423.3 |
| 3,672,795 | 6/1972 | Arutunoff | 417/423.3 |
| 4,128,735 | 12/1978 | Zemren | 174/65 R |
| 4,388,969 | 6/1983 | Marshall | 166/65.1 |
| 4,524,834 | 6/1985 | Barron et al. | 166/65.1 |
| 4,537,257 | 8/1985 | Todd | 166/369 |
| 4,798,243 | 1/1989 | Curington | 166/65.1 |

*Primary Examiner*—Richard A. Bertsch
*Assistant Examiner*—Peter Korytnyk
*Attorney, Agent, or Firm*—James E. Bradley

[57] ABSTRACT

A discharge head for an electrical submersible pump allows the pump assembly to be supported on coiled tubing. The discharge head has a cable passage through which the power cable passes. A motor lead extends from the motor alongside the pump and to the discharge head. The discharge head has flow passages that are offset relative to the longitudinal axis of the discharge head. An annulus seal mounted to the discharge head seals the annulus surrounding the discharge head. A power cable extends through the coiled tubing in one embodiment and is strapped to the coiled tubing in another embodiment.

15 Claims, 3 Drawing Sheets

ELECTRICAL SUBMERSIBLE PUMP DISCHARGE HEAD

BACKGROUND OF THE INVENTION

1. Field of the Invention

This invention relates in general to electrical submersible pumps for wells, and in particular to a discharge head for use with an electrical submersible pump suspended on coiled tubing within the well.

2. Description of the Prior Art

A conventional electrical submersible pump installation for oil wells supports the downhole pump assembly on production tubing. The production tubing is made up of sections of metal pipe secured together by threaded couplings. The submersible pump assembly includes at least one electrical motor, and at least one centrifugal pump. The pump normally locates above the motor and has a discharge head that secures to the production tubing. The production tubing supports the weight of the pump assembly as it is lowered into the well. The well fluid drawn into the intake of the submersible pump will be pumped through the tubing to the surface.

The electrical submersible pump must be maintained from time to time. This requires a workover rig which can pull the sections of tubing from the well to retrieve the pump, then lower a repaired or replaced pump back into the well. This is time consuming and expensive.

One proposal has been to support the pump on the power cable that extends to the electrical motor. The would eliminate the need for tubing and the need for a workover rig to pull the tubing for pump maintenance. Conventional power cable, however, does not have sufficient strength to support the weight of the pump assembly in the well. Consequently, a special cable must be utilized that has sufficient strength to support the weight of the pump in the well. While some of these units have been installed, the expense of the cable has been too high to make this type of assembly common.

It has also been proposed to support an electrical submersible pump on coiled tubing. Coiled tubing is a continuous metal pipe of smaller diameter than typical production tubing. Coiled tubing will coil onto a large reel and can be unrolled into the well. The coiled tubing would have the strength to support the pump assembly in the well. While it requires a unit to uncoil and coil the tubing, the pulling and running back in procedure should be less time consuming than the process of pulling conventional production tubing from the well with a workover rig. Also, coiled tubing would allow the pump to be installed in a live well through a stripper. While the concept of a coiled tubing suspended pump is feasible, this assembly is not commercially available at this time.

SUMMARY OF THE INVENTION

A discharge head for a coiled tubing supported electrical submersible pump assembly includes a body. The body has a neck on its upper end which secures to a coupling of the coiled tubing. A cable passage extends downward through the body and terminates at a lower end that is laterally offset relative to the longitudinal axis of the body. The cable extends through this cable passage and couples to a motor lead extending alongside the pump down to the motor.

A flow passage also extends through the body, however it is completely separate from the cable passage.

The flow passage has a lower end that is located on the longitudinal axis. The lower end of the body connects to the pump. The upper end of the flow passage is offset from the longitudinal axis and terminates in an outlet for discharging well fluid into the casing surrounding the coiled tubing. In the preferred embodiment, the upper portion comprises a plurality of passages, each spaced circumferetially from each other.

In the preferred embodiment, an annulus seal surrounds the discharge head and seals to the casing. The annulus seal serves as a packer for isolating the casing above the discharge head from the pump intake below. The annulus seal secures to the discharge head and is run in with the pump assembly.

In one embodiment, the power cable extends through the coiled tubing. The cable passage extends through the neck. In another embodiment, the power cable is strapped to the exterior of the coiled tubing. The upper end of the cable passage extends to a shoulder at the base of the neck.

DETAILED DESCRIPTION OF THE INVENTION

Referring to Figure the well has casing 11 installed. Casing 11 may also be a liner installed within larger diameter casing, with the term "casing" as used herein referring both to a liner and to casing. The electrical submersible pump assembly will be suspended within the casing 11. The electrical submersible pump assembly includes a motor 13, which is an alternating current motor. Motor 13 drives a shaft that extends through a seal section (not shown) for driving a centrifugal pump 15. Pump 15 is conventional and comprises a large number of stages of impellers and diffusers.

Figure 2:
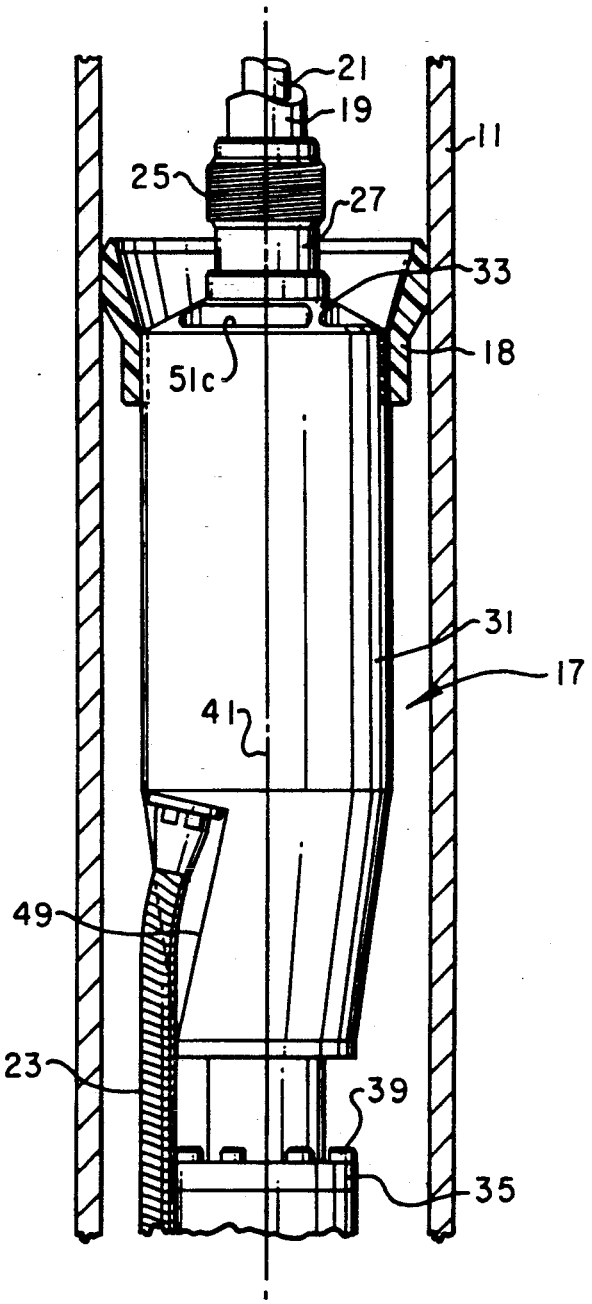
FIG. 2 is an enlarged side view of the discharge head of the electrical submersible pump assembly of FIG. 1.
Figure 3:
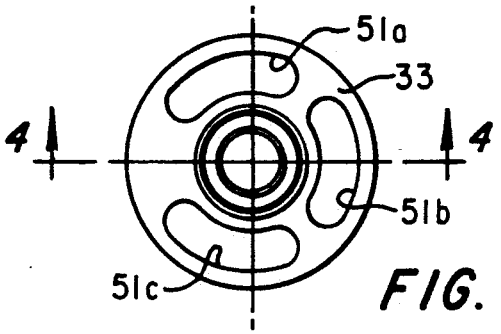
FIG. 3 is a top view of the discharge head of FIG. 2.

A discharge head 17 mounts to the upper end of pump 15. Seal means, comprising an annular seal 18 in the embodiment shown, is carried by discharge head 17 for sealing discharge head 17 to casing 11. As shown in FIG. 2, seal 18 may be a generally cup shaped flexible elastomeric seal 18 which slides down casing 11 as the pump assembly is lowered into the well. Seal 18 prevents well fluid from flowing downward past seal 18 when pump 15 is operating. Seal 18 may be secured to discharge head 17 by various means.

Discharge head 17 secures to coiled tubing 19 which extends to the surface and supports the weight of the electrical submersible pump assembly. Coiled tubing 19 is metal tubing that is continuous and shipped and stored on a large reel (not shown) at the surface. A three-phase electrical power cable 21 extends through coiled tubing 19. Power cable 21 extends through discharge head 17 and has a lower end which connects to a conventional motor lead 23. Motor lead 23 extends alongside pump 15 and into electrical engagement with motor 13.

Referring to FIG. 2, discharge head 17 is supported on coiled tubing 19 by a coupling 25 located on the lower end of coiled tubing 19. Coupling 25 secures to a neck 27 of discharge head 17, the neck 27 having external threads 29 (FIG. 4).

Discharge head 17 has a tubular body 31 that extends downward from neck 27. Body 31 and neck 27 comprise a single integral member. Body 31 is a metal member, having an upward facing conical shoulder 33 located at the base of neck 27. Neck 27 has a lesser outer diameter than the outer diameter of body 31, defining the shoulder 33. Body 31 has a cylindrical exterior below shoulder 33. Seal 18 secures to the cylindrical exterior of body 31.

At the lower end of body 31, a flange 35 serves as means for securing discharge head 17 to the upper end of pump 15. Threaded fasteners 39 extend through holes 37 (FIG. 4) in flange 35 and into threaded receptacles in pump 15.

Figure 1:
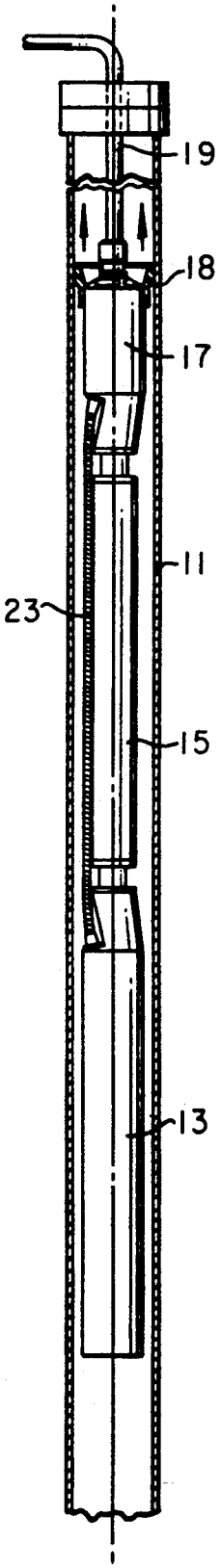
FIG. 1 is a side view illustrating an electrical submersible pump assembly constructed in accordance with this invention, shown partially schematic.
Figure 4:
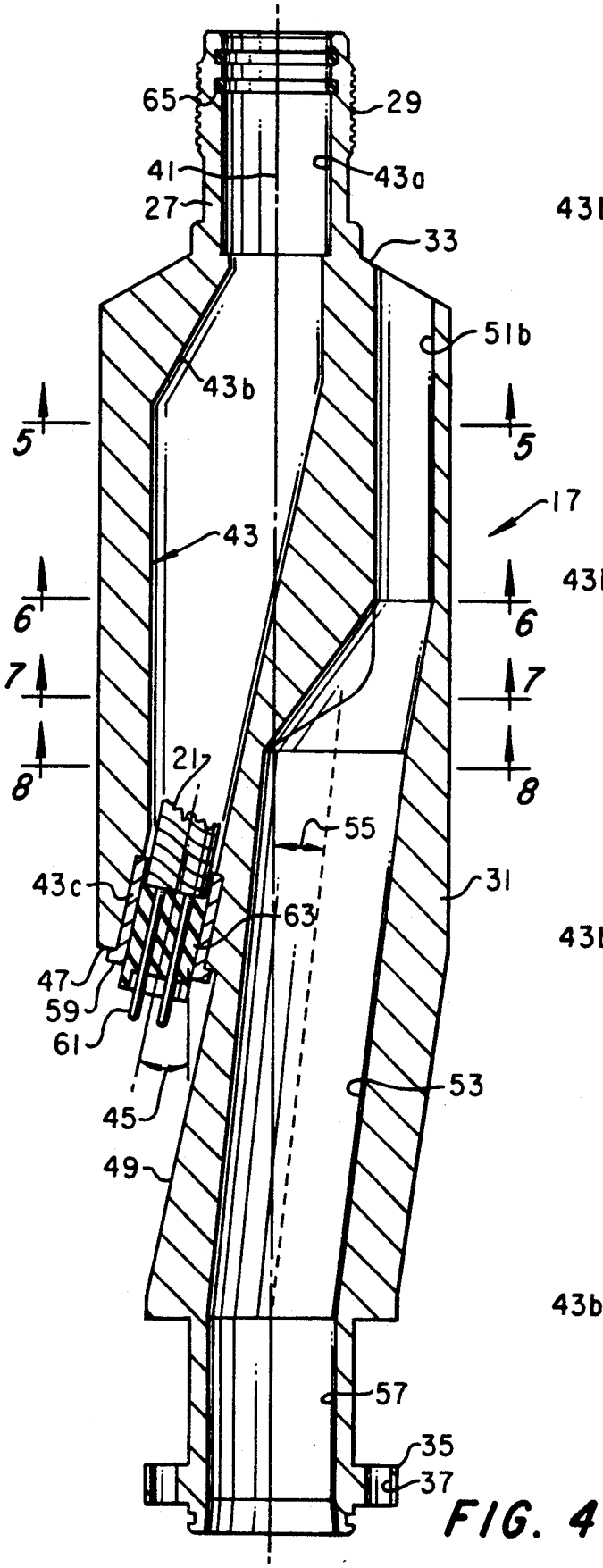
FIG. 4 is a sectional view of the discharge head of FIG. 2, taken along the line 4—4 of FIG. 3.

Referring to FIG. 4, body 31 has a longitudinal axis 41 that coincides with the longitudinal axis extending through motor 13 and pump 15 (FIG. 1). A cable passage 43 extends through body 31. Cable passage 43 has an upper portion **43*a* that is cylindrical and coaxial with longitudinal axis 41. An intermediate portion 43*b* joins upper portion 43*a*. Intermediate portion 43*b* begins an angled portion which terminates at a lower portion 43*c*, located on a downward and outward facing shoulder 47. Shoulder 47 is located in a notch or recess 49 formed in the lower portion of body 31. Lower passage portion 43*c* has an axis that is laterally offset from longitudinal axis 41. Also, it inclines at an angle 45 that is approximately 15 degrees relative to longitudinal axis 41 in the embodiment shown. As shown in FIGS. 5–8, intermediate portion 43*b* is elongated initially, resulting in an oblong cross section. This oblong cross section becomes less pronounced in FIGS. 6 and 7, and in FIG. 8 it is substantially circular. The cross section in the lower portion 43*c* is circular. The power cable 21 will extend through cable passage 43 and terminates in lower portion 43*c* for connecting to motor lead 23. Shoulder 47 is spaced a considerable distance above the flange 35**.

Figure 5:
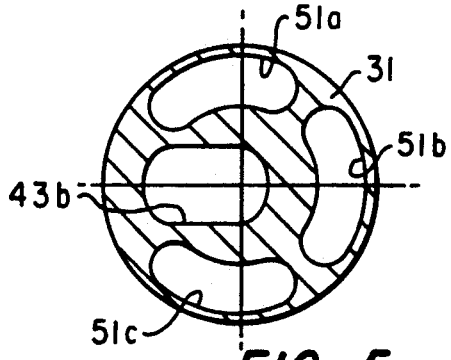
FIG. 5 is a sectional view of the discharge head of FIG. 2, taken along the line 5—5 of FIG. 4.
Figure 6:
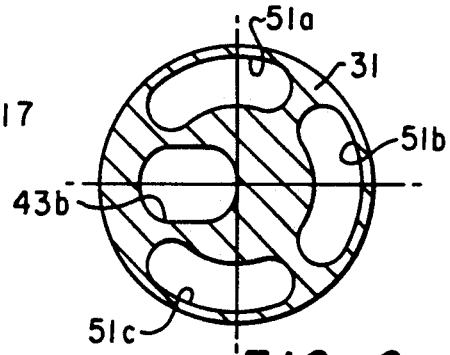
FIG. 6 is a sectional view of the discharge head of FIG. 2, taken along the line 6—6 of FIG. 4.

A plurality of upper flow passages **51*a, b, c* have outlets at upper shoulder 33 of body 31. Upper flow passages 51*a, b, c,* shown in FIG. 5, are generally arcuate in cross section. Also, they are circumferentially spaced apart from each other. Upper flow passages 51*a, b, c* surround three sides of cable passage 43**.

Figure 7:
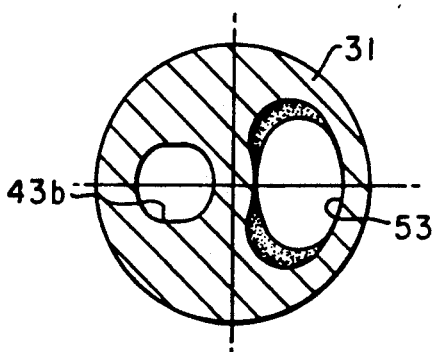
FIG. 7 is a sectional view of the discharge head of FIG. 2, taken along the line 7—7 of FIG. 4.
Figure 8:
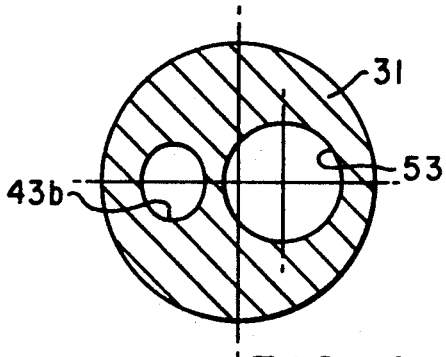
FIG. 8 is a sectional view of the discharge head of FIG. 2, taken along the line VIII—VIII of FIG. 4.

Upper flow passages **51*a, b, c* incline and converge downward relative to each other and join an intermediate flow passage 53 at a common junction as illustrated in FIG. 7. Intermediate flow passage 53 extends downward at an angle 55 relative to longitudinal axis 41. Angle 55 is also approximately 15 degrees in the embodiment shown. Intermediate flow passage 53 terminates in a lower flow passage 57 at the lower end. Lower flow passage 57 is circular in cross section. Preferably the cross-sectional area of the lower flow passage 57 is approximately the same as the cross-sectional area of intermediate flow passage 53. Also, preferably the sum of the cross-sectional areas of the upper flow passages 51*a, b, c* is approximately equal to the cross-sectional area of the intermediate flow passage 53. Consequently, the flow area remains generally constant throughout the discharge head 17**.

In the embodiment shown in FIGS. 1–8, the power cable 21 extends downward and terminates in an electrical connector 59. Electrical connector 59 fits sealingly in passage lower portion **43*c*. Electrical connector 59 has three pins 61, each of which is soldered to one of the conductors of power cable 21. Pins 61 are supported in an electrical insulator 63. A mating electrical connector (not shown) on the upper end of motor lead 23 (FIG. 2) releasably connects to electrical connector 59. A seal means including seals 65 in the upper cable passage 43*a* seals power cable 21, preventing leakage of well fluid into the cable passage 43*a, b, c***.

In operation, the operator will assemble the motor 13 to the pump 15 through a seal section (not shown). The operator solders the conductors at the lower end of power cable 21 to electrical connector 59 and connects the upper end of motor lead 23 to electrical connector 59. The operator will extend motor lead 23 alongside pump 15. Annulus seal 18 will be mounted to discharge head 17. The operator secures coiled tubing coupling 25 to threads 29 (FIG. 4) of discharge head 17.

The operator then lowers the entire assembly into the well on coiled tubing 19. The operator handles this by utilizing a conventional coiled tubing deployment (not shown) at the surface. The annulus seal 18 slides downward through casing 11 until the assembly reaches the desired depth.

To produce well fluid, the operator supplies electrical power to power cable 21. The power energizes motor 13, which will drive the pump 15. Fluid will be produced out pump 15 upward through the flow passages 57, 53, and **51*a, b,* and *c*. The fluid flows up casing 11 in the annulus surrounding coiled tubing 19. Annulus seal 18 isolates the intake of pump 15, which is at the lower end of pump 15**.

Figure 9:
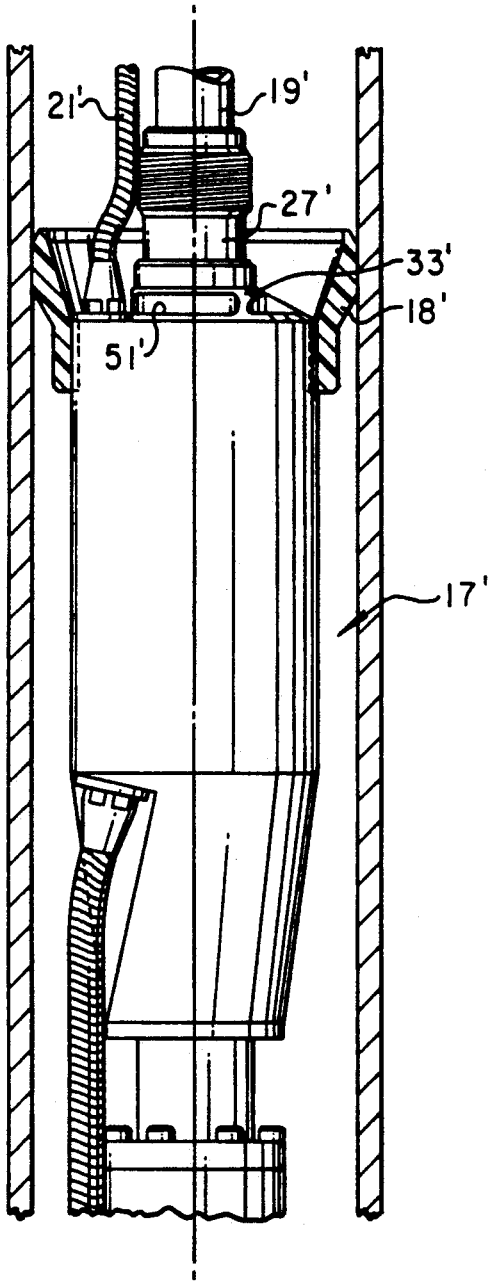
FIG. 9 is a side view of an alternate embodiment of a discharge head constructed in accordance with this invention.
Figure 10:
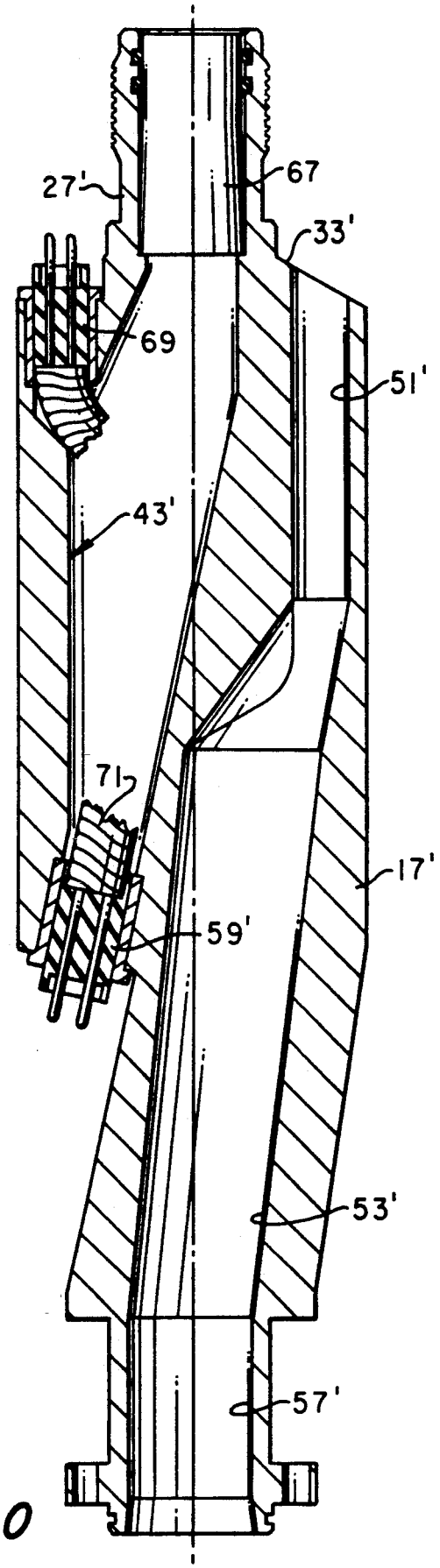
FIG. 10 is a sectional view of the discharge head of FIG. 9.

FIGS. 9 and 10 illustrate an alternate embodiment of discharge head 17'. In this embodiment, the power cable 21' is strapped to the exterior of the coiled tubing 19', rather than extending through the coiled tubing. The cable passage 43' has an upper end at shoulder 33' rather than in neck 27'. A plug 67 is secured in neck 27'. An upper electrical connector 69 of the same type as lower electrical connector 59' sealingly locates in the upper end of cable passage 43'. Power cable 21, has a mating electrical connector on its lower end that couples to upper electrical connector 69. A short feed through cable 71 extends within cable passage 43' between upper electrical connector 69 and lower electrical connector 59'.

In the alternate embodiment, the well fluid is discharged in the same manner through fluid passages 51', 53', and 57' as in the first embodiment. The cable passage 43' provides a bypass for the cable 21' for the annulus seal 18'.

The invention has significant advantages. The discharge head supports the electrical submersible pump assembly on the coiled tubing, and allows discharge into the casing. The discharge head provides an effective means for coupling the cable extending through the coiled tubing to the motor lead. The annulus seal eliminates the need for installing a packer in the well prior to lowering the pump assembly. The discharge head provides an effective means of bypassing the power cable past the annulus seal around the discharge head.

While the invention has been shown in only one of its forms, it should be apparent to those skilled in the art that it is not so limited, but is susceptible to various changes without departing from the scope of the invention.

I claim:

1. A discharge head for an electrical submersible pump assembly which is installed on metal coiled tubing within casing of a well, the pump assembly having an electrical motor secured to a lower end of a submersible pump, comprising in combination:

a body having an upper end, a lower end, and a longitudinal axis;

a neck located on the upper end of the body;

coupling means for coupling the coiled tubing to the neck;

a cable passage extending through the body for receiving a power cable for supplying power to the motor;

a flow passage extending through the body separate from the cable passage, the flow passage having a lower end that is located on the longitudinal axis at the lower end of the body and an upper end that is laterally offset relative to the longitudinal axis for discharging well fluid into the casing;

means at the lower end of the flow passage for securing the pump to the lower end of the body; and seal means mounted to the discharge head for sealing the discharge head to the casing, isolating fluid in the casing above the discharge head from fluid in the casing below the discharge head.

2. The discharge head according to claim 1 further comprising electrical connector means mounted in a lower portion of the cable passage for connecting the power cable to a motor lead.

3. The discharge head according to claim 1 wherein a lower end of the cable passage is located above the lower end of the body.

4. The discharge head according to claim 1 wherein the seal means comprises an annular cup shaped elastomeric seal that frictionally engages the casing as the pump assembly is lowered into the well.

5. The discharge head according to claim 1 wherein the flow passage has a lower portion that comprises a single passage and an upper portion that comprises a plurality of laterally spaced apart passages.

6. The discharge head according to claim 1 wherein the power cable is located within the coiled tubing, and wherein the cable passage extends through the neck on the longitudinal axis of the body.

7. A discharge head for an electrical submersible pump assembly which is installed on metal coiled tubing within casing of a well, the pump assembly having an electrical motor secured to a lower end of a submersible pump, the coiled tubing havinq a power cable extending therethrough for supplying power to the electrical motor, the discharge head comprising in combination:

a body having an upper end, a lower end, and a longitudinal axis;

a neck located on the upper end of the body on the longitudinal axis, the neck having a cable passage that has an upper portion located on the longitudinal axis for receiving a power cable, the neck having means for securing the coiled tubing to the neck, the cable passage having a lower portion that terminates in a lower end above the lower end of the body and laterally offset relative to the longitudinal axis for securing the power cable to a motor lead extending alongside an upper portion of the pump;

a flow passage extending through the body separate from the cable passage, the flow passage having a lower portion that is located on the longitudinal axis at the lower end of the body and at least one upper portion with an upper end that is below the upper end of the cable passage and laterally offset relative to the longitudinal axis for discharging well fluid into the casing; and means at the lower end of the flow passage for securing the pump to the body.

8. The discharge head according to claim 7 wherein the flow passage has a plurality of circumferentially spaced apart upper portions, each terminating in a separate upper end.

9. The discharge head according to claim 7 further comprising seal means mounted to the discharge head for sealing an annulus between the discharge head and the casing.

10. The discharge head according to claim 7 wherein the seal means comprises an annular cup shaped elastomeric seal which frictionally slides against the casing as the pump assembly is lowered into the well.

11. The discharge head according to claim 7 wherein the lower portion of the cable passage inclines relative to the longitudinal axis.

12. The discharge head according to claim 7 further comprising electrical connector means located at the lower end of the power cable in the lower portion of the cable passage for connecting to the motor lead.

13. In an electrical submersible pump assembly which is installed on metal coiled tubing within casing of a well, the pump assembly having an electrical motor secured to a lower end of a submersible pump and a power cable extending alongside the coiled tubing for supplying power to the motor, an improved means for connecting the pump to the coiled tubing, comprising in combination:

a body having an upper end, a lower end, a longitudinal axis, and a cylindrical exterior wall;

seal means mounted to the exterior wall of the body for providing a seal between the body and the casing;

a neck located on the upper end of the body on the longitudinal axis, the neck having a base which defines an upward facing shoulder on the body;

coupling means for coupling the coiled tubing to the neck;

a cable passage extending through the body, having an upper end located on the upward facing shoulder of the body for receiving the power cable and a lower portion that terminates in a lower end above the lower end of the body, the lower portion of the cable passage being inclined and laterally offset relative to the longitudinal axis;

lower electrical connector means mounted in the lower portion of the cable passage for connecting to a motor lead portion of the power cable which extends alongside the pump to the motor;

a flow passage extending through the body separate from the cable passage, the flow passage having an intermediate portion that inclines relative to the longitudinal axis and a lower portion that is located on the longitudinal axis at the lower end of the body, the flow passage having a plurality of circumferentially spaced apart upper portions which join the intermediate portion and extend upward to upper ends that are located at the upward facing shoulder of the body for discharging well fluid into the casing surrounding the coiled tubing; and means at the lower end of the flow passage for securing the pump to the body.

14. The electrical submersible pump assembly according to claim 13 wherein the seal means comprises an annular cup shaped elastomeric seal that frictionally engages the casing as the pump assembly is lowered into the well.

15. The electrical submersible pump assembly according to claim 13 further comprising upper electrical connector means mounted at the upper end of the cable passage for connecting a feed through portion of the power cable located in the cable passage to the portion of the power cable that extends alongside the coiled tubing.

* * * * *